US005977498A

United States Patent [19]

Levine

[11] Patent Number: 5,977,498

[45] Date of Patent: Nov. 2, 1999

[54] SUBMERSIBLE SWITCH WITH STATIC SEAL

[75] Inventor: Mark Levine, Plainview, N.Y.

[73] Assignee: Echlin, Inc., Branford, Conn.

[21] Appl. No.: 08/935,214

[22] Filed: Sep. 22, 1997

[51] Int. Cl.[6] ..... H01H 9/04

[52] U.S. Cl. ..... 200/302.1; 200/11 R; 200/43.08; 200/336

[58] Field of Search ..... 200/6 R–6 C, 200/11 R–11 J, 43.01, 43.03, 43.04, 43.08, 43.11, 81 R, 564, 567, 570, 571, 302.1, 302.3, 336

[56] References Cited

U.S. PATENT DOCUMENTS

| | | | |
|---|---|---|---|
| 2,857,185 | 10/1958 | Hofer | 287/1 |
| 3,013,129 | 12/1961 | Root | 200/44 |
| 3,115,555 | 12/1963 | Lescarboura | 200/5 |
| 4,074,097 | 2/1978 | Hutchinson et al. | 200/81.9 R |
| 4,260,860 | 4/1981 | Niihama et al. | 200/6 R |
| 4,308,434 | 12/1981 | Roeser | 200/6 R |
| 4,406,933 | 9/1983 | Boozer | 200/47 |
| 4,476,360 | 10/1984 | Theurer | 200/302.1 |
| 4,710,601 | 12/1987 | Raab et al. | 200/302.3 |
| 4,789,766 | 12/1988 | Krause | 200/302.3 |
| 4,890,467 | 1/1990 | Krause et al. | 70/369 |
| 4,937,407 | 6/1990 | Osika | 200/302.3 |
| 5,061,831 | 10/1991 | Stevens et al. | 200/302.1 |
| 5,334,811 | 8/1994 | Burgener et al. | 200/302.3 |

FOREIGN PATENT DOCUMENTS

| | | | |
|---|---|---|---|
| 1410425 | of 1965 | France . | |
| 1 208 382 | of 1966 | Germany . | |
| 1 805 965 | of 1970 | Germany . | |
| 23 44 856 | of 1975 | Germany | H01H 13/06 |

*Primary Examiner*—Michael Friedhofer
*Attorney, Agent, or Firm*—Darby & Darby

[57] ABSTRACT

A submersible rotary switch protects against moisture contamination and includes a housing containing an actuating mechanism and an oppositely disposed contact device confined in a contact compartment statically sealed by a flexible boot. A driver disposed between the compartments connects the actuating mechanism to the contact device to effect rotational translation therebetween.

27 Claims, 4 Drawing Sheets

SUBMERSIBLE SWITCH WITH STATIC SEAL

FIELD OF THE INVENTION

The invention relates to rotary switches and more particularly a submersible switch having a static seal to protect electrical contacts disposed in a contact compartment from moisture-induced contamination.

BACKGROUND OF THE INVENTION

Rotary switches are often utilized for selectively establishing one or more electrical connections by turning a dial, key or knob. The knob, in turn, connects to a contact mechanism disposed in a contact compartment and responsive to rotation of the knob to move an electrical contact relative to fixed contacts.

One of the more common examples of an economical rotary switch includes a typical engine starter responsive to rotation of a keyed cylinder to complete a start circuit. The keyed cylinder provides a measure of security in selectively enabling only those persons entrusted with the corresponding key to rotate the switch elements and actuate the start circuit. The starter is typically disposed within the interior of a vehicle, thus shielded from extreme environmental conditions.

Although the implementation of a rotary switch in the confines of an automobile interior minimally exposes the contact compartment to moisture, keyed conventional switches utilized in more extreme environments associated with watercraft, snowmobiles and construction equipment are prone to malfunction due to contamination and excessive oxidation of the contacts. The contamination often arises in such vehicles because the keyway formed in the cylinder and the annular space around the key cylinder provide undesirable moisture paths leading indirectly to the switch contacts.

With the ever-increasing popularity of environmentally exposed vehicles, those skilled in the art have explored different starter switch designs to satisfy customer concerns regarding reliability and security. One proposal includes providing a relatively inexpensive rotary dynamic seal, such as an O-ring, around the key cylinder or around a circular element of a contact rotor to minimize water entry. Other economical dynamic seal designs have implemented a "boot nut" in which a flat rubber washer, having a slit to allow entry of the key, is mounted forward of the keyhole. The rubber element rotates as the key turns to provide some measure of protection.

While such proposals are somewhat beneficial for limited exposure to the elements, continuous exposure, such as through complete submersion of a personal watercraft, typically overwhelms the limited sealing capability due to the keyway moisture path. Over time, the sliding motion of the rotating shaft relative to the dynamic seal generally causes the seal to deform and fatigue, substantially compromising the effectiveness of the seal. As a result, many manufacturers implement starters without keyed mechanisms, thereby increasing the risk of theft of the vehicle.

A related proposal for addressing the problem with relatively expensive static seals involves hermetically sealing the contacts from the outside environment with a static seal. Static seals in contrast to dynamic seals, remain fixed in an unchanging orientation. U.S. Pat. No. 5,061,831 illustrates a hermetically sealed switch for storing for long periods of time. The switch includes a metallic housing separated into two airtight compartments by a flexible metallic diaphragm welded to the interior radial surface of the housing. The center of the diaphragm is welded around the periphery of a narrow metallic actuator to maintain the seal. Bounding each end of the housing are respective rotors formed with respective grooves for engaging the respective ends of the actuator. The top rotor comprises a manual selector for activating the switch. The bottom rotor includes a contact disposed opposite a contact plate that mounts a plurality of connection elements.

Operation of the hermetic switch involves rotating the selector knob to correspondingly pivot the actuator and translate the knob movement to the contact rotor. As the contact rotor turns, the contact either makes or breaks circuits with the fixed contacts. While the relatively flexible nature of the metallic diaphragm realizes a static airtight seal between the two compartments, the design anticipates a one-shot actuation for military applications.

While the hermetic switch is beneficial for its intended purposes, the metallic nature of the sealing components, coupled with the required welding steps necessary to effect airtight sealing causes the design to be undesirable from a cost standpoint for non-airtight sealing applications. Moreover, the metal to metal welds between the diaphragm and metallic housing are subject to embrittlement after substantial use, resulting in component fatigue and loss of sealing capability.

Therefore, those skilled in the art have recognized the need for an economical rotary switch for use in extreme environments and capable of preventing moisture from contaminating a contact compartment and maintaining a high level of reliability throughout many actuations over a substantial period of time. The need also exists for such a switch to allow a measure of vehicle security through keyed access. The submersible switch of the present invention satisfies these needs.

SUMMARY OF THE INVENTION

The present invention provides an economical static seal to prevent moisture from entering a contact compartment to contaminate and compromise the operability of a rotary switch exposed to extreme environments. This feature gives the switch a high level of reliability even when key operated. Moreover, by incorporating a manufacturable design, the present invention lends itself readily to high production and low cost manufacture.

To realize the advantages identified above, the present invention, in one form, comprises a statically sealed transmission for use with a rotary switch having a rotatable actuating mechanism and an oppositely disposed rotatable contact device. The transmission includes a cylindrical frame having proximal and distal ends and including a radial divider wall to define first and second compartments within the frame. The wall is formed with an opening for interconnection between the compartments. Respective actuator and contact rotors are disposed at the respective proximal and distal ends of the frame and are rotatably connected respectively to the actuating mechanism and the contact device. A pivoting mechanism is interposed between the rotors and received through the opening to extend through both compartments and translate rotational displacement from the actuator rotor to the contact rotor. The transmission further includes an open ended flexible boot disposed in the proximal compartment and having one end formed into a base and fixedly clamped. Thus forming a static seal to the wall to cover the opening and the other end defining a neck fixedly clamped thus forming a second static seal to the pivoting mechanism. The boot is operable, as the proximal rotor turns to transmit a rotational force on the pivoting mechanism and cause a corresponding translated rotation on the contact mechanism, to maintain a static moisture seal around the opening.

In another form, the present invention comprises a submersible switch having one or more operational states to selectively establish electrical communication. The switch includes a hollow housing formed with proximal and distal ends and an interior divider to define first and second compartments. The divider is formed with a central opening to join the compartments. A rotatable actuating mechanism is mounted at one end of the housing and is disposed proximate the first compartment. The switch further includes a contactor disposed at the other end of the housing opposite the actuating mechanism and including a rotatable contact device. The contact device is disposed in the second compartment and is responsive to rotational movement to selectively establish electrical contact between at least one set of contact elements. A driver pivotally mounted on the divider to extend through the opening includes a shaft having respective proximal and distal ends diagonally coupled to the actuating mechanism and the contactor to translate relative rotary movement from the actuating mechanism to the contact device and effect state changes in the switch. An elastomeric hollow boot is sealably disposed in the first compartment substantially around the divider and axially clamped to the driver to sealably cover the opening and statically seal the first compartment from the second compartment.

In yet another form, the present invention comprises a method of preventing moisture from entering a contact compartment in a rotary switch. The switch has a housing formed with a divider wall to define respective actuator and contact compartments and for mounting a keyed actuating mechanism disposed in the actuator compartment and a contact device housed in the contact compartment. The method includes the steps of selecting a rotary transmission of the type including respective actuator and contact rotors for mounting to the respective actuator mechanism and contact device, and a driver pivotably disposed on the divider wall and coupled between the rotors and the compartments to translate rotary displacement therebetween. The method also includes the step of statically sealing the contact compartment with a flexible boot disposed in the actuator compartment and having one end formed into a base and statically mounted to the wall to cover the opening and the other end defining a neck statically clamped to the driver.

Other features and advantages of the present invention will be apparent from the following detailed description when read in conjunction with the accompanying drawings.

DETAILED DESCRIPTION OF THE INVENTION

Rotary switches provide a convenient means for manually changing the state of an electrical circuit. A common application for such switches involves vehicle starters, which typically operate via rotary actuation of a keyed cylinder. In popular vehicles such as personal watercraft or snowmobiles, where complete submersion of the vehicle in the elements often occurs, implementation of a keyed security mechanism in conventional rotary switches is problematic due to the moisture path created by the keyway.

Figure 1:
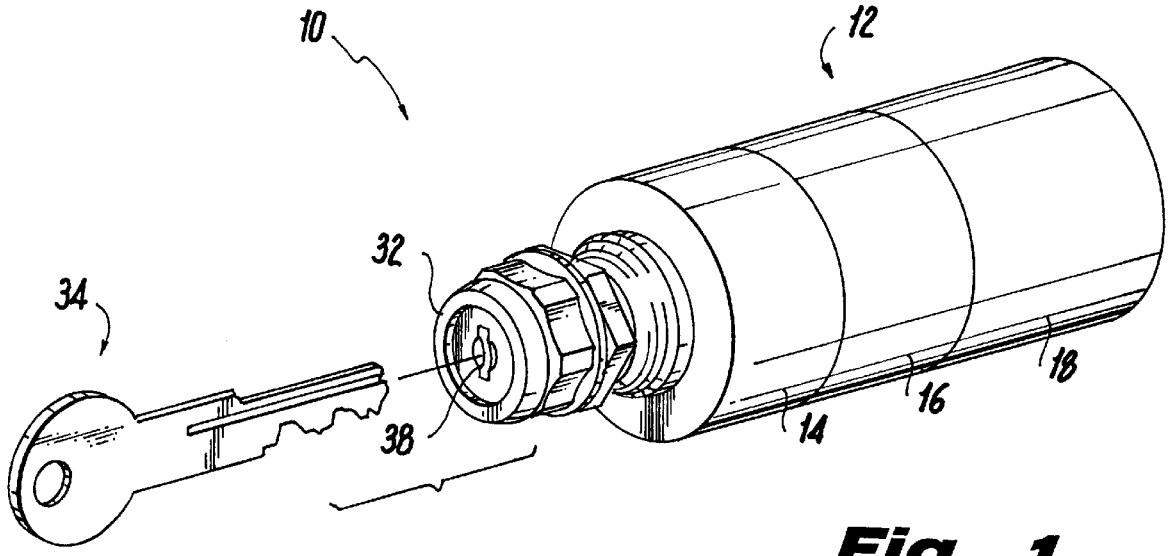
FIG. 1 is perspective view of a submersible switch according to one embodiment of the present invention.
Figure 2:
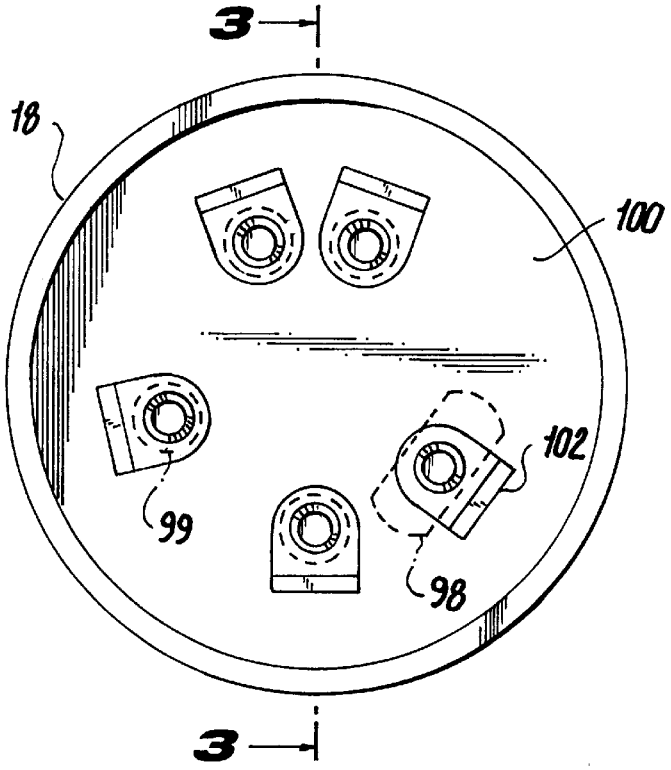
FIG. 2 is an enlarged rear view of the submersible switch shown in FIG. 1.
Figure 3:
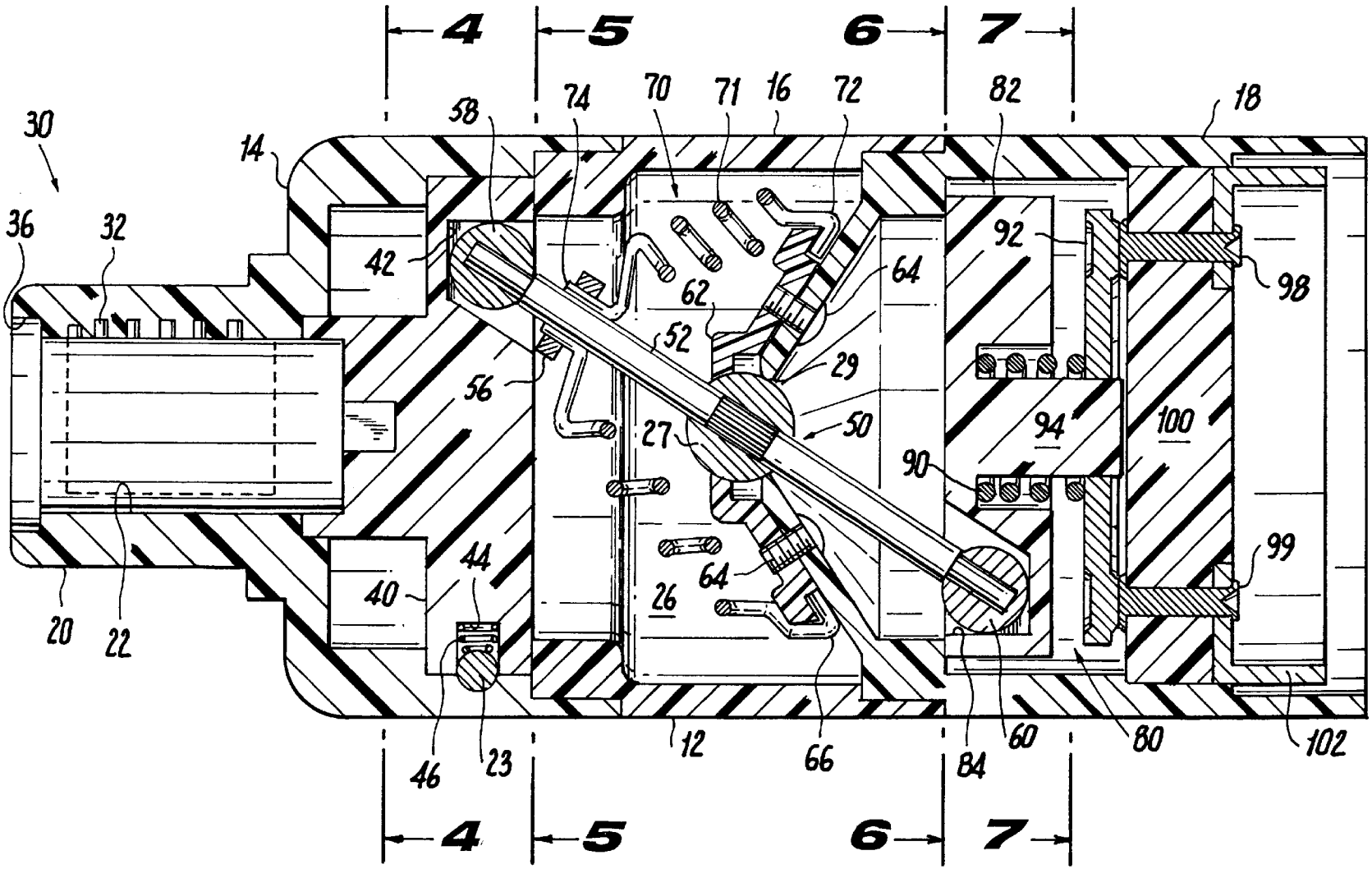
FIG. 3 is an axial cross-sectional view taken along line 3—3 of FIG. 2.
Figure 4:
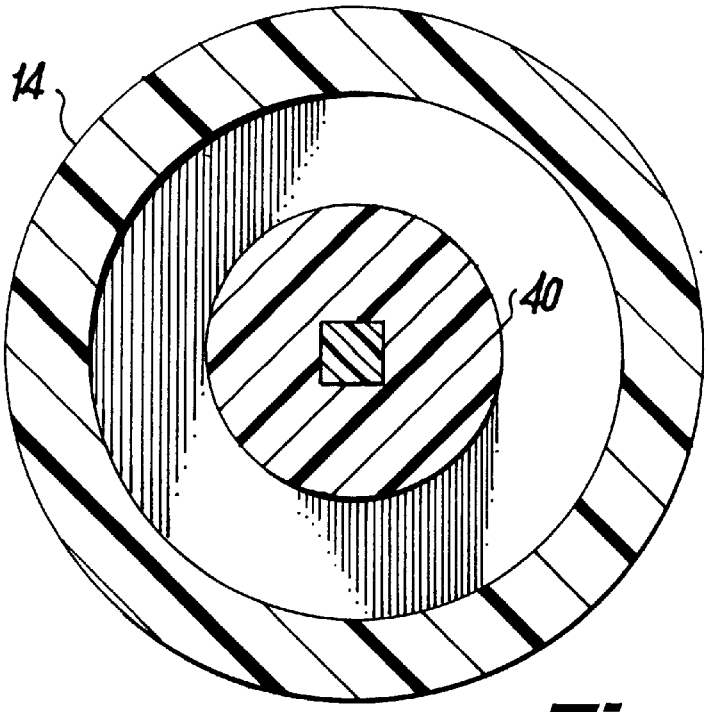
FIG. 4 is a radial cross-sectional view taken along line 4—4 of FIG. 3.
Figure 5:
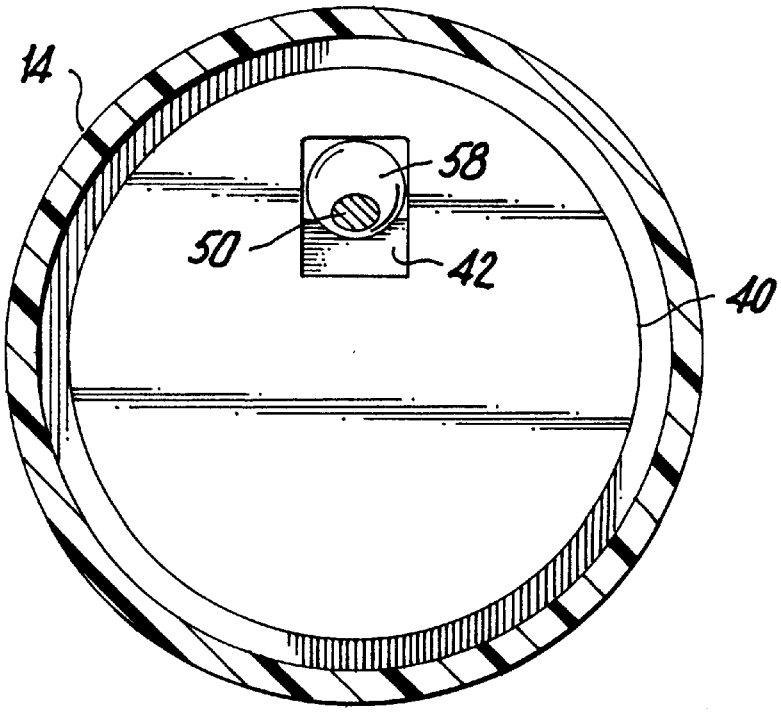
FIG. 5 is a radial cross sectional view taken along line 5—5 of FIG. 3.
Figure 6:
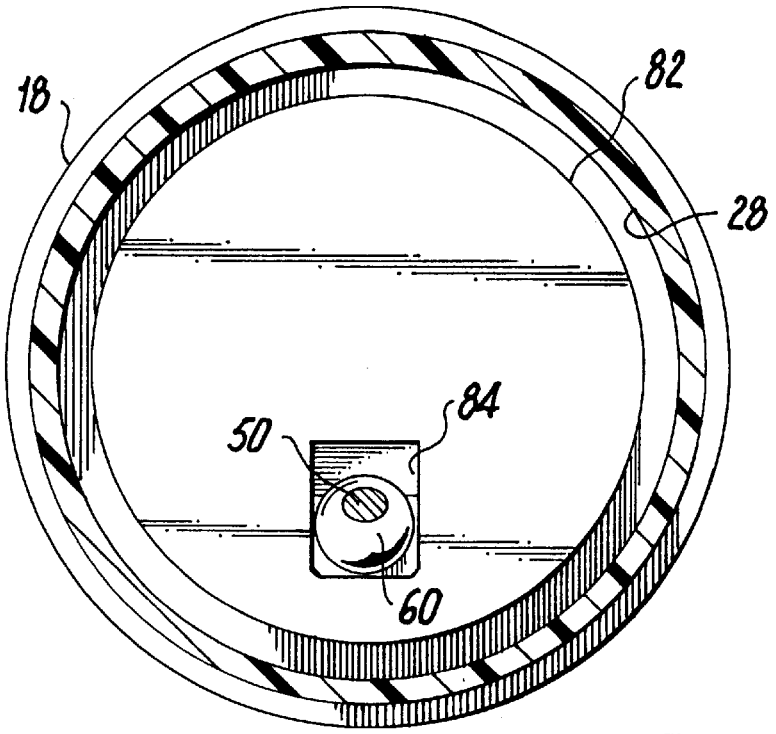
FIG. 6 is a radial cross-sectional view taken along line 6—6 of FIG. 3.

Referring now to FIGS. 1 and 3, the submersible switch of the present invention, generally designated 10, protects against moisture contamination and includes a housing 12 containing an actuating mechanism 30 and an oppositely disposed contact device 80 confined in a contact compartment statically sealed by a flexible boot 70. A driver 50 disposed between the compartments connects the actuating mechanism to the contact device to effect rotational translation therebetween.

With particular attention to FIG. 3, the housing 12 comprises a formed hollow cylinder constructed from polymer plastic and segmented into respective proximal, intermediate and distal portions 14, 16 and 18. The proximal portion includes a cylindrical cap having an axially projecting and reduced-in-diameter radial wall 20 defining a lock chamber 22. Formed radially into the interior of the cap is an inwardly opening cavity 23 for cooperating with the actuating mechanism to form a detent device. The intermediate portion 16 is complementally formed to connect to the proximal portion and extend axially therefrom. The distal portion 18 axially couples to the intermediate portion and includes a formed divider wall 24 to define respective actuator and contact compartments 26 and 28. The wall projects axially inwardly into the actuator compartment in a frusto-conical configuration and includes a central opening defining a bearing seat 29. The opening interconnects the actuator cavity compartment 26 with the contact compartment 28.

With reference to FIGS. 1, and 3–5, the actuating mechanism 30 mounts within the proximal portion 14 of the housing 12 and includes a keyed locking mechanism 32 responsive to insertion and rotation of a key 34 through a keyed cylinder 36 having a formed keyway 38. An actuator rotor 40 comprising a formed cylindrical disk is fixed to an axial drive shaft extending from the keyed cylinder. A recess 42 is formed into the backside of the rotor proximate the rotor periphery for coupling to the proximal end of the driver 50. An outwardly opening blind bore 44 is formed radially into the rotor and nests a spring 46 for biasing a ball against the cavity 23 to define the detent device. The detent device conveniently provides defined rotary stop positions so as to hold the rotor firmly in intermediate rotary positions.

Further referring to FIG. 3, the driver 50 comprises an elongated formed rod 52 to extend into both compartments 26 and 28 and having a ball 27 fixedly mounted intermediate its length to nest in the bearing seat 29 and form a pivot. A radial clamp 56 mounts to the portion of the rod extending into the actuator compartment to statically secure one end of the boot 70. Disposed at the opposite ends of the rod are respective floating balls 58 and 60 formed to nest within respective recesses 42 and 84 formed in the respective actuator and contact rotors 40 and 82. The balls conveniently help to reduce friction between the rod and the respective rotors during rotational translation.

Cooperating with the bearing seat to hold the bearing in place and effect smooth pivoting action is a bearing cap 62. The cap is complementally formed to overlie and mount to the divider wall 24 with a plurality of spaced apart fasteners 64. Alternatively, the cap may be fastened to the divider wall by integral snap devices, cementing or welding as is well known in the art. The cap includes a formed annular lip 66 extending radially around the divider wall and the bearing seat to statically secure the other end of the boot 70 in position.

The static seal 70, or boot, is formed from an inexpensive natural or synthetic elastomer, such as rubber, and includes a body 71 configured in an open-ended frusto-conical bellows shape. One end defines an oversized-in-diameter base 72 to snugly secure around the annular lip 66 while the other end defines a reduced-in-diameter neck 74 for clamping to the rod 52 by means of a radial clamp 56. Positioning the boot in this manner places the seal directly over the opening 29 that joins the two compartments 26 and 28. Since the opening comprises the only possible entry-point for moisture into the contact compartment 28, by sealably covering the opening with the static boot 70, moisture contamination is avoided.

Those skilled in the art will recognize and appreciate that the flexible nature of the boot 70 allows substantial deformation of the body 71 during pivoting action of the driver without any relative, or dynamic, action between the ends of the boot and the respective mounting points. This serves to increase the reliability and operable life of the boot by eliminating the wear and tear commonly associated with dynamic seals.

Referring now to FIGS. 2, 3, 6 and 7, the contact device 80 is confined within the sealed contact compartment 28 and includes a contact rotor 82 disposed in confronting relation to the actuator rotor 40. The contact rotor includes a formed second recess 84 for coupling to the distal end of the driver 50. Formed on the opposite side of the contact rotor is an annular axially opening cavity 88 for nesting a bias spring 90 in compression against a contact plate 92.

Figure 7:
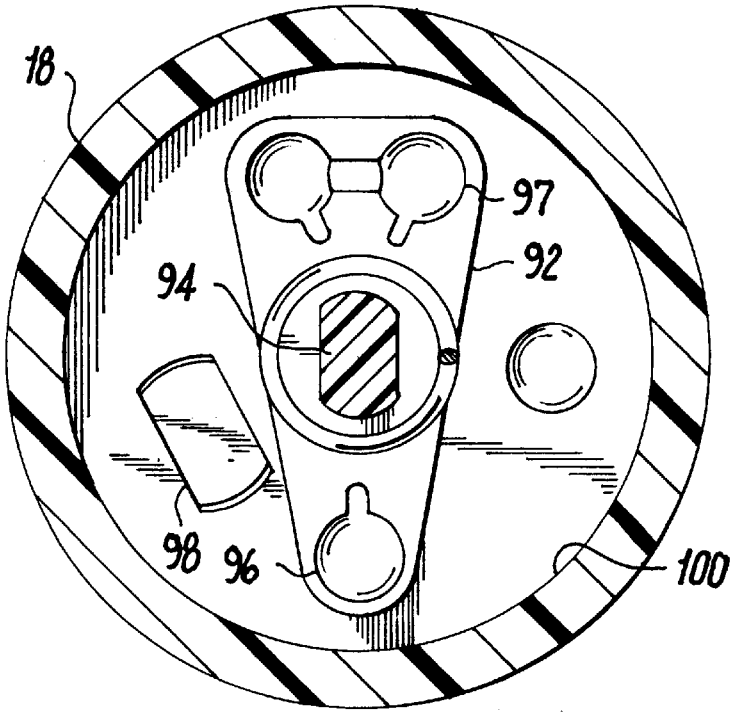
FIG. 7 is a radial cross-sectional view taken along line 7—7 of FIG. 3.

Referring more particularly to FIG. 7, the contact plate 92 is rotatably coupled to the contact rotor 82 through a shaft 94, and includes a first set of spaced apart and oppositely disposed contacts 96 and 97 positioned peripherally on the plate to circumscribe a rotary path and selectively engage a second set of contacts 98 and 99 mounted to a fixed base 100 formed of insulating material such as a polymer and disposed along the contact path. The respective sets of contacts are wired to respective electrical terminals 102 (FIG. 3) disposed on the backside of the base to provide a convenient interface for soldering to respective circuit leads (not shown). The solder joints are typically encapsulated with a suitable potting compound to permanently seal the backside of the contact compartment from moisture contamination. The multiple contacts complement the detenting feature of the present invention by providing multiple circuit connections through actuation of a single rotary element.

Those skilled in the art will recognize that the subassembly comprising the respective rotors 40 and 82 coupled together by the pivoting driver 50 defines a rotary transmission in the sense that rotational displacement from the actuator rotor is transmitted to the contact rotor. Because the driver is disposed in diagonal pivoting arrangement rather than a straight direct drive, the driver shaft does not rotate about its longitudinal axis. This allows a static seal to be mounted to a portion of the driver to cover the opening 29 and provide a reliable, yet economic, moisture barrier between the actuator and contact compartments.

The submersible switch of the present invention readily lends itself to a variety of applications. For example, the contacts may be arranged in a myriad of configurations to the starter motor, the ignition system, various accessories, an electronic choke, and/or the grounding of a magneto to stop the engine. The switch housing is typically carried by a platform and mounted behind the control panel of the vehicle such that the keyway is readily accessible on the panel. The terminals of the switch are then wired to place the switch in the circuit path between the vehicle battery, the vehicle starter, and any additional powered devices such as gauges.

In operation, the vehicle operator desiring to enable the start circuit to start the craft merely inserts the key 34 into the keyed cylinder 36 and rotates the cylinder clockwise to correspondingly turn the actuator rotor 40. As the rotor turns, the first recess 42 urges the proximal end of the diagonally disposed driver 50 along the same path to impart a stirring motion. The fitted boot 70, having the neck 74 clamped to the proximal portion of the rod, flexibly follows the driver along the stirring path. The flexible nature of the boot provides an inherent strain relief on the respective mounted ends of the seal to minimize wear. The distal end of driver, because of the centrally mounted pivot, undergoes a substantially similar stirring actuation to impart a rotational force on the contact rotor 82 in the area of the second recess 84. Movement of the contact rotor correspondingly turns the contact plate to change the positioning of the first set of contacts 96 and 97 relative to the second set of contacts 98 and 99 to make respective electrical connections. With the vehicle starter circuit path completed, the vehicle starter motor is energized to start the engine.

In the event that moisture seeps into the actuator compartment via the keyway 38, the static mounting of the boot 70 to the annular lip 66 and the driver shaft 50 blocks the moisture from entering the bearing seat 29 and potentially continuing on into the contact compartment. The boot's sealability remains highly reliable even during actuation of the switch because of the seals' flexibility and static mounting. Following use of the vehicle, the moisture will eventually evaporate out of the actuator compartment through the keyhole. A drain hole may also be incorporated through the housing proximal portion 14. Because the contact compartment remains free from moisture contamination, the likelihood of corrosion on the switch contacts is substantially minimized.

Those skilled in the art will recognize and appreciate the many benefits and advantages afforded the submersible switch of the present invention to minimize costs while maximizing manufacturability, reliability and security.

Of notable importance is the feature that most of the components implemented are readily fabricated from relatively inexpensive, natural, and synthetic materials such as plastic and rubber. By minimizing the cost of materials, the design is more desirable to low cost vehicle manufacturers such as personal watercraft and snowmobiles. Moreover, cost savings are further enhanced due to the relatively straightforward switch design which reduces labor expenses by avoiding costly processes such as metal-to-metal welds and other similar methods.

The enhanced reliability of the present invention realized by the static nature of the economical sealing boot also constitutes an important feature of the present invention. Because the boot mounts to the divider wall and the driver shaft without undergoing relative sliding action at the mounting points, frictional wear is eliminated, the life of the seal is substantially prolonged, and the reliability of the switch is correspondingly improved.

The design of the submersible switch also affords implementation of a security access device such as a keyed locking mechanism. This is made practical by the superior sealing capability of the static seal which maintains functionality even in the presence of moisture accessed through the keyhole into the actuator compartment.

While the invention has been particularly shown and described with reference to the preferred embodiments thereof, it will be understood by those skilled in the art that various changes in form and detail may be made therein without departing from the spirit and scope of the invention.

What is claimed is:

1. A statically sealed transmission for use with a rotary switch having a rotatable actuating mechanism and an oppositely disposed rotatable contact device, said transmission including:

a cylindrical frame comprising a polymer plastic, said frame having proximal and distal ends and including a radial divider wall to define first and second compartments within said frame, said wall formed with an opening for interconnection between said compartments;

respective actuator and contact rotors disposed at the respective proximal and distal ends of said frame and rotatably connected respectively to the actuating mechanism and the contact device;

a pivoting mechanism interposed between said rotors and received through said opening to extend through both compartments and translate rotational displacement from said actuator rotor to said contact rotor; and an open ended flexible boot disposed in said proximal compartment and having one end formed into a base and fixedly mounted to said wall to cover said opening and the other end defining a neck fixedly clamped to said pivoting mechanism, said boot operable, as said proximal rotor turns to transmit a rotational force on said pivoting mechanism and cause a corresponding translated rotation on said contact mechanism, to maintain a static moisture seal around said opening.

2. A statically sealed transmission according to claim 1 wherein:

said divider wall is formed integral with said frame and including a raised annular lip disposed around said opening to project into said actuator compartment and complementally formed to sealably receive said boot base in immovable radial engagement; and said pivoting mechanism includes a shaft to radially receive said boot neck in immovable radial engagement.

3. A statically sealed transmission according to claim 2 wherein:

said boot is formed in a substantially frusto-conical bellows configuration with said base formed in an oversized-in-diameter shape and said neck formed in a reduced-in-diameter configuration.

4. A statically sealed transmission according to claim 3 wherein:

said boot is formed of a material comprising an elastomer.

5. A statically sealed transmission according to claim 1 wherein:

said actuator rotor is formed with a first recess opening inwardly toward said first compartment for receiving the proximal end of said pivoting mechanism; and said contact rotor is formed with a second recess disposed in diagonal confronting relation to said first detent.

6. A statically sealed transmission according to claim 5 wherein:

said pivoting mechanism distal and proximal ends terminate in respective bearing elements to nest in said respective recesses and reduce frictional engagement therebetween.

7. A statically sealed transmission according to claim 1 wherein:

said opening defines a bearing seat; and said pivoting mechanism comprises an elongated rod formed intermediate with a ball to nest in said bearing seat and define a pivot.

8. A submersible switch having one or more operational states to selectively establish electrical communication, said switch including:

a hollow housing formed with proximal and distal ends and an interior divider to define first and second compartments, said divider formed with a central opening to join said compartments;

a rotatable actuating mechanism mounted at one end of said housing and disposed proximate said first compartment;

a contactor disposed at the other end of said housing opposite said actuating mechanism and including a rotatable contact device, said device disposed in said second compartment and responsive to rotational movement to selectively establish electrical contact between at least one set of contact elements;

a driver pivotally mounted on said divider to extend through said opening and including a shaft having respective proximal and distal ends diagonally coupled to said actuating mechanism and said contactor to translate relative rotary movement from said actuating mechanism to said contact device and effect state changes in said switch; and an elastomeric boot sealably disposed in said first compartment substantially around said divider and axially clamped to said driver to sealably cover said opening and establish a static seal between said respective compartments.

9. A submersible switch according to claim 8 wherein:

said housing is formed of a synthetic material and configured substantially cylindrical.

10. A submersible switch according to claim 9 wherein:

said housing is formed of a material comprising a polymer plastic.

11. A submersible switch according to claim 8 wherein:

said boot includes respective radially formed and outwardly opening first and second ends;

said divider is formed integral with said housing and including a raised annular lip disposed around said opening to project into said first compartment and complementally formed to sealably receive said boot first end in tight fitting radial engagement; and said driver shaft radially receives said second end in tight fitting radial engagement.

12. A submersible switch according to claim 11 wherein:

said boot is formed flexibly in a substantially frusto-conical bellows configuration and including a reduced-in-diameter neck for axially clamping to said driver and an oversized-in-diameter base for tight-fitting engagement around said annular lip.

13. A submersible switch according to claim 12 wherein: said boot is formed of a material comprising an elastomer.

14. A submersible switch according to claim 8 wherein said actuating mechanism includes:

a rotatable knob disposed at the proximal end of said housing; and a first rotor coupled to said knob and disposed in said first compartment to connect to said driver.

15. A submersible switch according to claim 14 wherein: said rotatable knob comprises a keyed locking mechanism responsive to an inserted key to activate said actuating mechanism.

16. A submersible switch according to claim 15 wherein: said housing is formed radially with an inwardly opening cavity;

said first rotor is formed radially with an outwardly opening bore, said bore nesting a biasing element and a ball urged outwardly by said spring whereby said first rotor and housing cooperate to bring said ball into selectable engagement with said cavity to form a detent device and establish selectable contact positions.

17. A submersible switch according to claim 14 wherein: said first rotor is formed with a cavity opening inwardly toward said first compartment for receiving the proximal end of said driver.

18. A submersible switch according to claim 8 wherein said rotatable contact device includes:

a fixed insulated terminal base having a first set of electrical contacts;

a second rotor disposed at the distal end of said housing to connect to the distal end of said driver and having a contact plate disposed in confronting relation to said terminal plate and including a second set of electrical contacts to rotate relative to said fixed terminal plate to selectively establish electrical connection between said first and second sets of contacts.

19. A submersible switch according to claim 18 wherein: said second rotor is formed with an axial inwardly opening cavity for receiving the distal end of said driver.

20. A submersible switch according to claim 19 wherein: said driver distal and proximal ends terminate in respective bearing elements to nest in said respective rotor cavities and reduce frictional engagement therebetween.

21. A submersible switch according to claim 8 wherein: said driver comprises an elongated rod.

22. A submersible switch according to claim 21 wherein: said divider opening defines a bearing seat; and said rod is formed intermediate with a ball bearing to nest in said seat and define a pivot.

23. A submersible switch having one or more operational states to selectively establish electrical communication between at least two contacts, said switch including:

a hollow cylindrical housing formed integrally with an interior divider to define first and second compartments, said divider formed with a central opening to join said compartments and a raised annular lip disposed around said opening in said first compartment;

a rotatable actuating mechanism mounted at one end of said housing and disposed proximate said first compartment, said actuating mechanism including a keyed locking mechanism responsive to an inserted key to activate said actuating mechanism and a first rotor coupled to said knob and disposed in said first compartment;

a contactor disposed at the other end of said housing opposite said actuating mechanism and including a rotatable contact device, said device disposed in said second compartment and including a fixed insulated terminal base having a first set of electrical contacts and a second rotor disposed at the distal end of said housing and having a contact plate disposed in confronting relation to said terminal plate, said contact plate including a second set of electrical contacts to rotate relative to said fixed terminal plate to selectively establish electrical connection between said first and second sets of contacts;

a driver pivotally mounted on said divider to extend through said opening and having a shaft diagonally coupled between said first and second rotors to translate relative rotary movement from said actuating mechanism to said contact device and effect state changes in said switch; and a flexible elastomeric boot formed in a substantially frusto-conical bellows configuration and including a first end complementally formed to be sealably received in tight fitting radial engagement around said annular lip in said first compartment, said boot formed with a second end for axially clamping to said driver to sealably cover said opening and statically seal said first compartment from said second compartment.

24. A statically sealed transmission for use with a rotary switch having a rotatable actuating mechanism and an oppositely disposed rotatable contact device, said transmission including:

a cylindrical frame having proximal and distal ends and including a radial divider wall to define first and second compartments within said frame, said wall formed with an opening for interconnection between said compartment;

respective actuator and contact rotors disposed at the respective proximal and distal ends of said frame and rotatably connected respectively to the actuating mechanism and the contact device;

a pivoting mechanism interposed between said rotors and received through said opening to extend through both compartments and translate rotational displacement from said actuator rotor to said contact rotor;

an open ended flexible boot disposed in said proximal compartment and having one end formed into a base and fixedly mounted to said wall to cover said opening and the other end defining a neck fixedly clamped to said pivoting mechanism, said boot operable, as said proximal rotor turns to transmit a rotational force on said pivoting mechanism and cause a corresponding translated rotation on said contact mechanism, to maintain a static moisture seal around said opening;

said divider wall being formed integral with said frame and including a raised annular lip disposed around said opening to project into said actuator compartment and complementally formed to sealably receive said boot base in immovable radial engagement; and said pivoting mechanism includes a shaft to radially receive said boot neck in immovable radial engagement.

25. A statically sealed transmission according to claim 24 wherein:

said boot is formed in a substantially frusto-conical bellows configuration with said base formed in an oversized-in-diameter shape and said neck formed in a reduced-in-diameter configuration.

26. A statically sealed transmission according to claim 25 wherein said boot is formed of a material comprising an elastomer.

27. A statically sealed transmission for use with a rotary switch having a rotatable actuating mechanism and an oppositely disposed rotatable contact device, said transmission including:

a cylindrical frame having proximal and distal ends and including a radial divider wall to define first and second compartments within said frame, said wall formed with an opening for interconnection between said compartments, said opening defining a bearing seat;

respective actuator and contact rotors disposed at the respective proximal and distal ends of said frame and rotatably connected respectively to the actuating mechanism and the contact device;

a pivoting mechanism comprising an elongated rod interposed between said rotors and received through said opening and extending through both compartments, said rod formed intermediate with a ball to nest in said bearing seat and define a pivot; and an open ended flexible boot disposed in said proximal compartment and having one end formed into a base and fixedly mounted to said wall to cover said opening and the other end defining a neck fixedly clamped to said pivoting mechanism, said boot operable, as said proximal rotor turns to transmit a rotational force on said pivoting mechanism and cause a corresponding translated rotation on said contact mechanism, to maintain a static moisture seal around said opening.

* * * * *